US010084271B2

(12) United States Patent
Xing et al.

(10) Patent No.: US 10,084,271 B2
(45) Date of Patent: Sep. 25, 2018

(54) PLUG CONNECTOR ASSEMBLY HAVING IMPROVED ARRANGEMENT STRUCTURE BETWEEN OUTER CASE AND PRINTED CIRCUIT BOARD

(71) Applicant: FOXCONN INTERCONNECT TECHNOLOGY LIMITED, Grand Cayman (KY)

(72) Inventors: Da-Wei Xing, Kunshan (CN); Jun Chen, Kunshan (CN); Jerry Wu, New Taipei, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/803,835

(22) Filed: Nov. 5, 2017

(65) Prior Publication Data

US 2018/0131144 A1 May 10, 2018

(30) Foreign Application Priority Data

Nov. 4, 2016 (CN) ..... 2016 1 0970089

(51) Int. Cl.
*H01R 24/60* (2011.01)
*H01R 13/62* (2006.01)
*H01R 107/00* (2006.01)

(52) U.S. Cl.
CPC ..... *H01R 24/60* (2013.01); *H01R 13/62* (2013.01); *H01R 2107/00* (2013.01)

(58) Field of Classification Search
CPC .... H01R 24/60; H01R 13/62; H01R 13/6658; H01R 13/6598; H01R 2107/00
USPC ..... 439/676, 660, 607.17, 352
See application file for complete search history.

(56) References Cited

U.S. PATENT DOCUMENTS 7,261,582 B2 * 8/2007 Wu ..... H01R 13/506 439/352
7,857,657 B2 * 12/2010 Kuwahara ..... H01R 12/62 439/497
8,267,713 B2 * 9/2012 Wu ..... H01R 13/6335 439/352
8,454,381 B2 * 6/2013 Wu ..... H01R 13/504 439/352
8,764,491 B2 * 7/2014 Wang ..... H01R 13/508 439/660

(Continued)

FOREIGN PATENT DOCUMENTS

CN 203574938 4/2014

*Primary Examiner* — Harshad C Patel
(74) *Attorney, Agent, or Firm* — Wei Te Chung; Ming Chieh Chang

(57) ABSTRACT

A plug connector assembly includes: a cable; a printed circuit board including a mating end for inserting into a mating connector, a connecting end electrically connected with the cable, and an intermediate portion between the mating end and the connecting end, the mating end defining plural conductive pads extending along a longitudinal direction of the printed circuit board for electrically connecting with the mating connector and arranged in a horizontal direction perpendicular to the longitudinal direction; and an outer case enclosing the intermediate portion of the printed circuit board and a part of the cable; wherein the intermediate portion defines on each of two side edges thereof a recessing portion filled by the outer case.

13 Claims, 6 Drawing Sheets

(56) References Cited

U.S. PATENT DOCUMENTS

| | | | | |
|---|---|---|---|---|
| 2010/0210142 | A1* | 8/2010 | McGrath | H01R 12/594 439/620.22 |
| 2011/0195586 | A1* | 8/2011 | Wu | H01R 13/512 439/152 |
| 2011/0306244 | A1* | 12/2011 | Zhang | H01R 9/034 439/624 |
| 2012/0064779 | A1* | 3/2012 | Wu | H01R 9/032 439/676 |
| 2013/0188325 | A1* | 7/2013 | Garman | H05K 9/0007 361/753 |
| 2014/0349496 | A1* | 11/2014 | Zhu | H05K 1/0219 439/108 |
| 2015/0044907 | A1* | 2/2015 | Kuang | H01R 9/038 439/607.22 |
| 2015/0111402 | A1* | 4/2015 | Hackman | H01R 13/648 439/98 |
| 2016/0329664 | A1 | 11/2016 | Wu et al. | |
| 2017/0207580 | A1 | 7/2017 | Wu et al. | |

* cited by examiner

PLUG CONNECTOR ASSEMBLY HAVING IMPROVED ARRANGEMENT STRUCTURE BETWEEN OUTER CASE AND PRINTED CIRCUIT BOARD

BACKGROUND OF THE INVENTION

1. Field of the Invention

The present invention relates generally to a plug connector assembly and more particularly to an improved arrangement structure between outer case and printed circuit board.

2. Description of Related Arts

China Patent Application Publication No. 203574938, issued on Apr. 30, 2014, shows a plug connector assembly including a printed circuit board, a cable electrically connected with the printed circuit board, and an outer case. The printed circuit board includes a mating end, a connecting end connecting with the cable, and an intermediate portion between the mating end and the connecting end. The size of the intermediate portion is same as the mating end such that if the outer case is formed by over molding, the side wall thereof may be difficult to cover the side edges of the intermediate portion of the printed circuit board.

An improved arrangement structure in a plug connector assembly is desired.

SUMMARY OF THE INVENTION

An object of the present invention is to provide an improved arrangement structure between outer case and printed circuit board in a plug connector for completely enclosing side edges of the printed circuit board by the outer case.

To achieve the above-mentioned object, a plug connector assembly comprises: a cable; a printed circuit board including a mating end for inserting into a mating connector, a connecting end electrically connected with the cable, and an intermediate portion between the mating end and the connecting end, the mating end defining a plurality of conductive pads extending along a longitudinal direction of the printed circuit board for electrically connecting with the mating connector and arranged in a horizontal direction perpendicular to the longitudinal direction; and an outer case enclosing the intermediate portion of the printed circuit board and a part of the cable; wherein the intermediate portion defines on each of two side edges thereof a recessing portion filled by the outer case.

DETAILED DESCRIPTION OF THE PREFERRED EMBODIMENT

Figure 1:
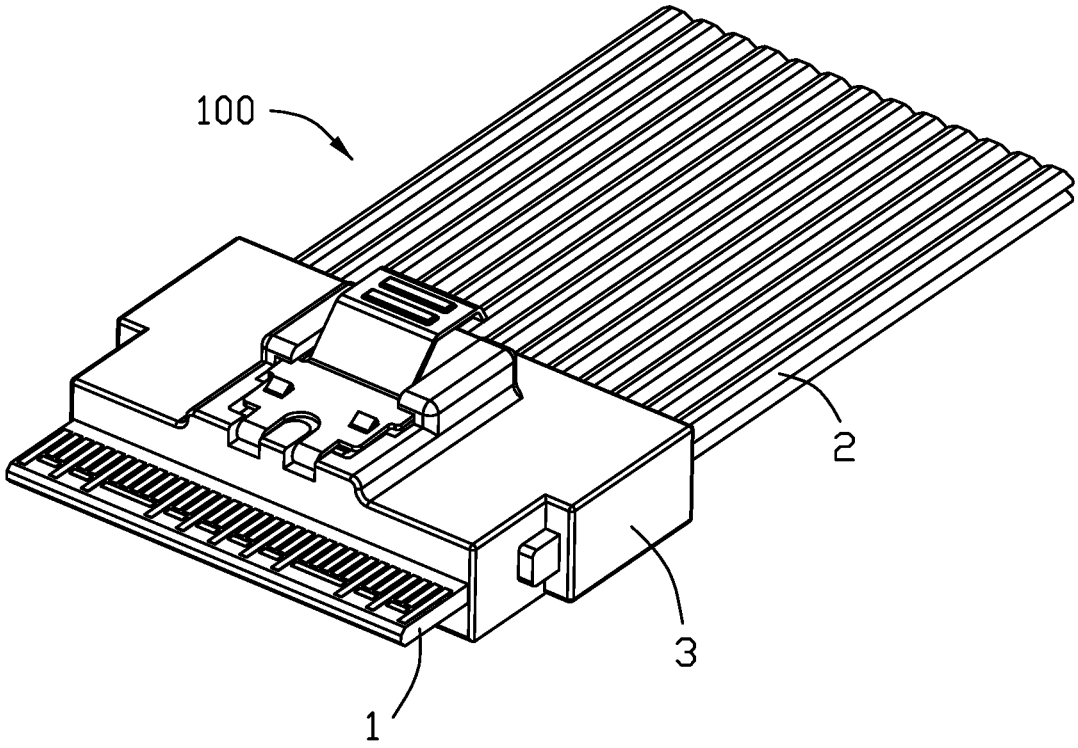
FIG. 1 is a perspective view of a plug connector assembly in accordance with the present invention.
Figure 2:
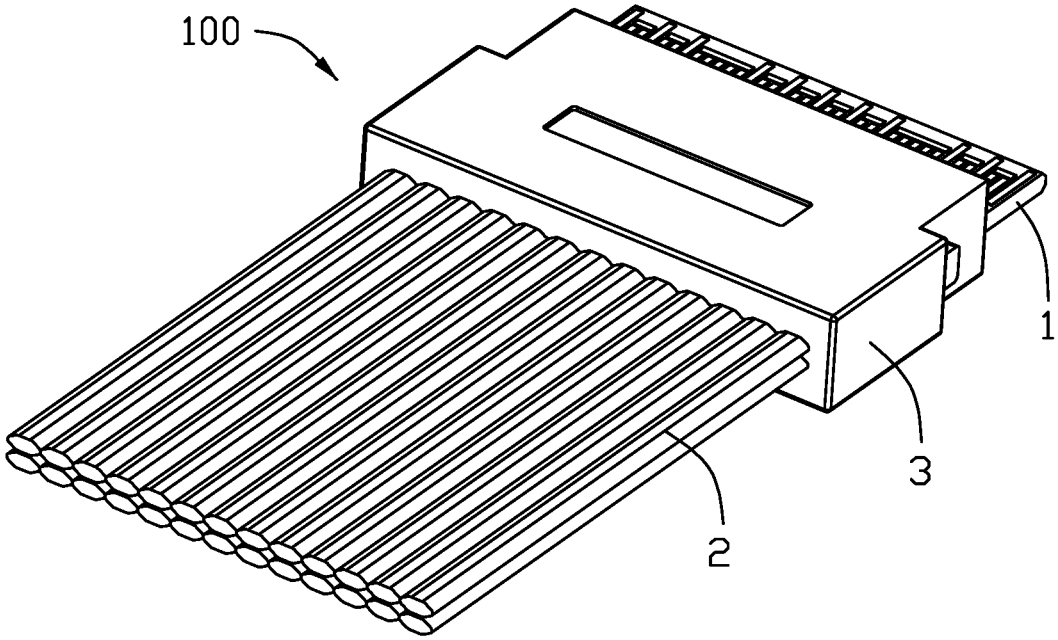
FIG. 2 is a perspective view similar to FIG. 1, but from a different aspect.
Figure 3:
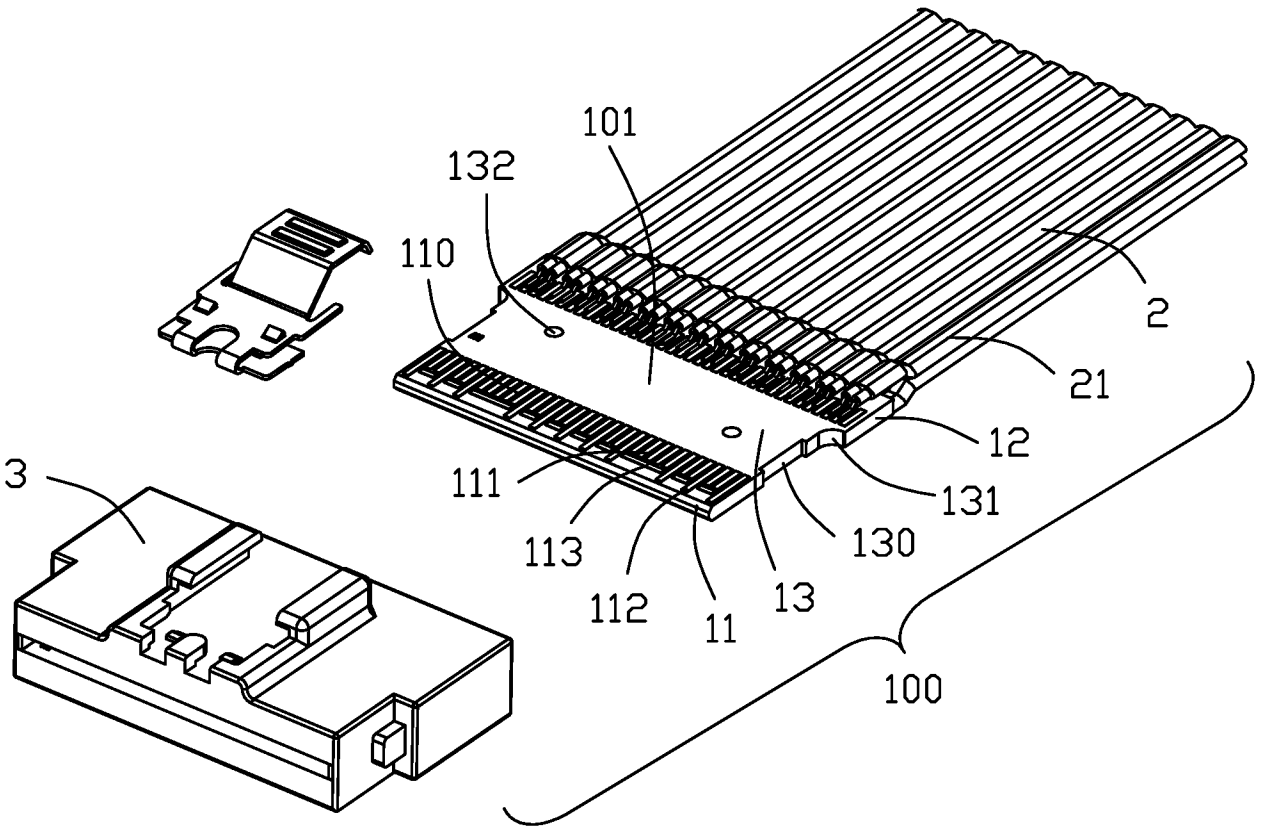
FIG. 3 is a partially exploded view of the plug connector assembly in FIG. 1.
Figure 4:
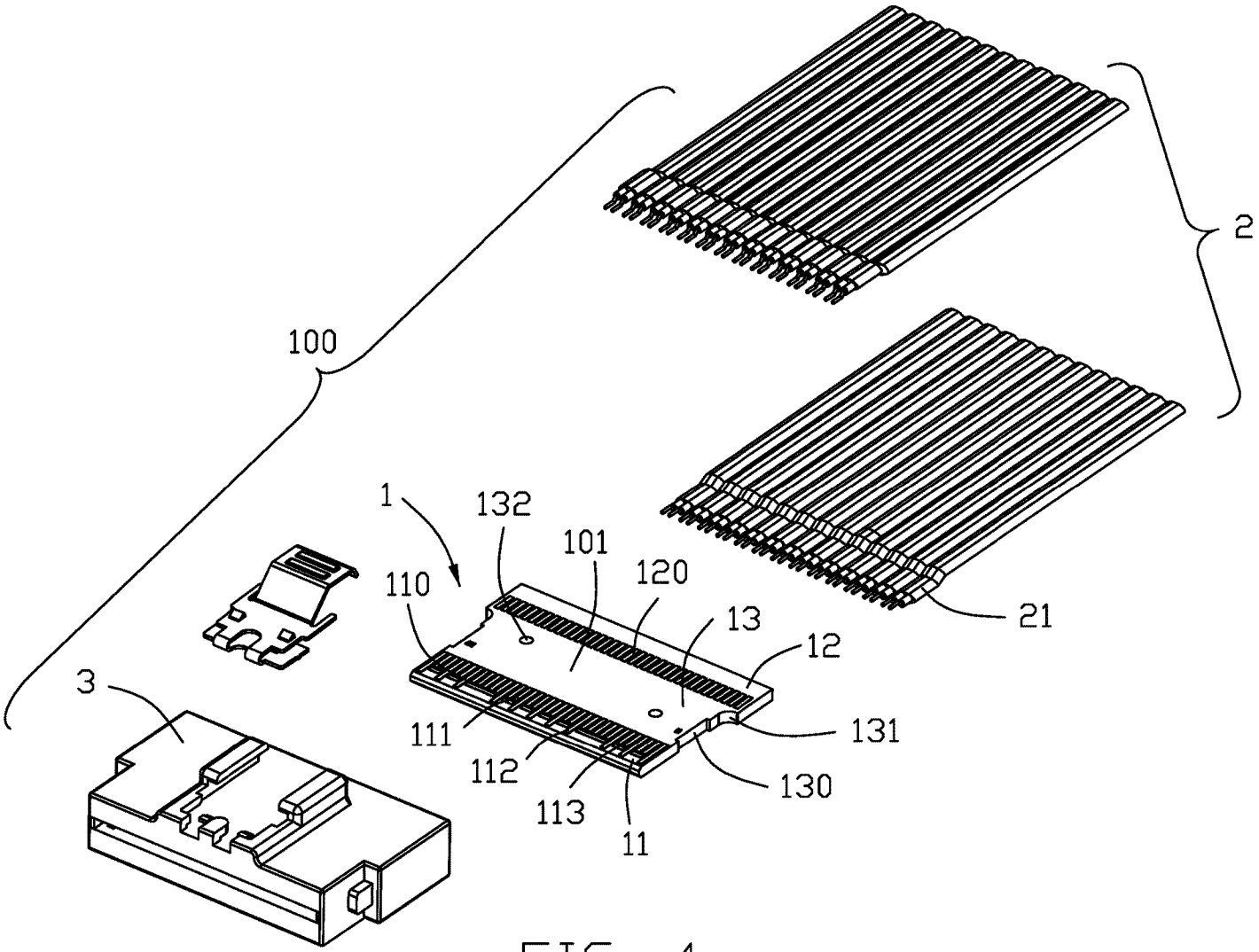
FIG. 4 is an exploded view of the plug connector assembly in FIG. 1.
Figure 5:
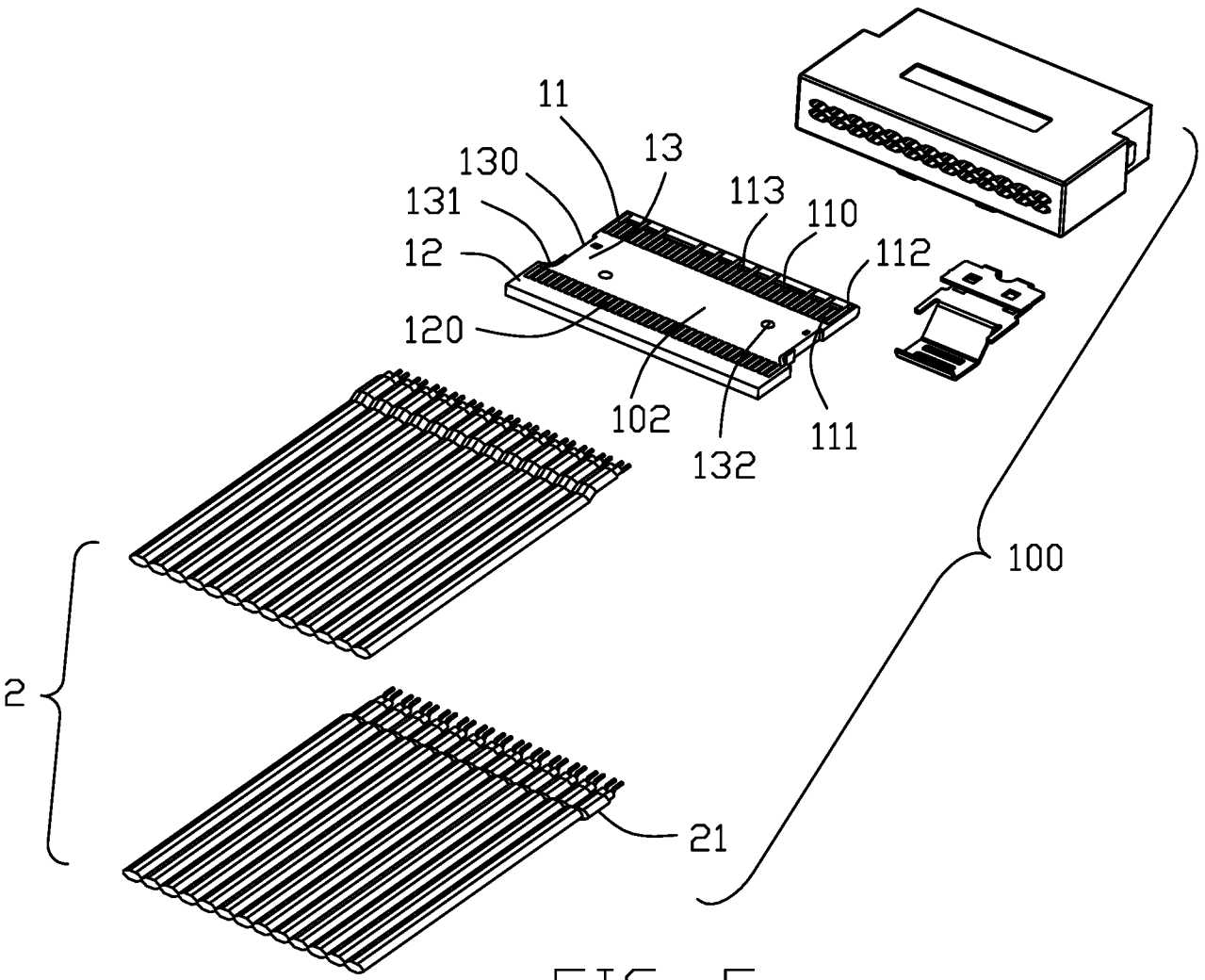
FIG. 5 is a exploded view similar to FIG. 4, but from a different aspect.
Figure 6:
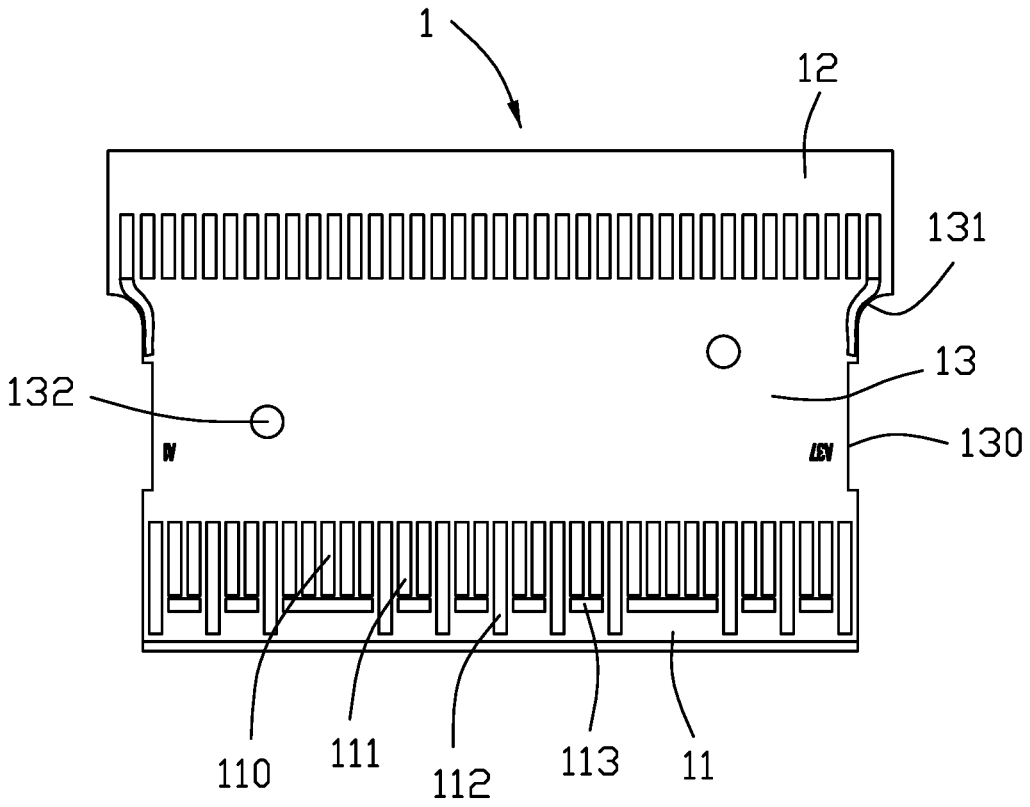
FIG. 6 is a top view of the plug connector assembly in FIG. 1.

Referring to FIGS. 1 to 6, a plug connector assembly in accordance with the present invention for mating with a mating connector (not shown), comprises a printed circuit board 1, a cable 2 electrically connected with the printed circuit board 1, an outer case 3 enclosing the printed circuit board 1 and the cable 2. In the present embodiment, the plug connector assembly 100 conforms to the SFF-8654 specification with a transmission rate of more than 22.5 Gbps per channel. The cable 2 is a flat structure comprising a plurality of core wires 21.

The printed circuit board 1 includes a mating end 11 for being inserted into the mating connector, a connecting end 12 connecting with the cable 2, a intermediate portion 13 connecting between the mating end 11 and the connecting end 12. The printed circuit board 1 defines a top surface 101 and an opposite bottom surface 102.

The mating end 11 defines a plurality of mating conductive pads 110 extending along a longitudinal direction of the printed circuit board 1 and spaced arranged along a horizontal direction vertical to the longitudinal direction, for connecting with the mating connector. The distance between the adjacent center lines of the adjacent mating conductive pads 110 is 0.6 mm. The mating conductive pads 110 includes a plurality of first mating pads 111 for transmitting data signal, controlling signal and power signal and so on, and a plurality of second mating pads 112 forwardly extending to beyond the first mating pads 111 for transmitting grounding signal. The mating end 11 further includes a plurality of grounding pads 113 disposed on a front side of the first mating pads 111, and the grounding pads 113 are arranged spaced and extended along the horizontal direction. The grounding pads 113 are connected to a ground layer in the printed circuit board 1 to improve the high frequency performance of the plug connector assembly 100 such as crosstalk and impedance matching, thus, the transmission speed of the plug connector assembly 100 can reach to 22.5 Gbps or more. The mating end 11 of the printed circuit board 1 exposes to the outer case 3, and the size along the horizontal direction is smaller than the size of the outer case 3 covering the intermediate portion 13 of the printed circuit board 1.

The connecting end 12 of the printed circuit board 1 defines a plurality of soldering conductive pads 120 extending along the longitudinal direction and arranged spaced along the horizontal direction. The core wires 21 are soldered with the corresponding soldering conductive pads 120. The top surface 101 and the bottom surface 102 of the printed circuit board 1 are arranged exactly the same, scilicet, the number and the arrangement of the matting conductive pads 110, the soldering pads 120 and the grounding pads 113 on the top surface 101 and the bottom surface 102 are the same.

Each of the opposite sides along the horizontal direction of the intermediate portion 13 of the printed circuit board 1 defines a recessing portion 130. The outer case 3 is over molded on the intermediate portion 13 of the printed circuit board 1 and a part of the cable 2, and filled into the recessing portion 130, so as to cover the sides of the intermediate portion 13. The thickness of the side edge of each recessing portion 130 of the printed circuit board 1 to the corresponding side edges of the outer case 3 is 0.55 mm. The size of the intermediate portion 13 of the printed circuit board 1 along the horizontal direction is smaller than the size of the connecting end 12 along the horizontal direction. The conjunction portion of the intermediate portion 13 and the connecting end 12 of the printed circuit board 1 are provided with a rounding structure 131 to increase the internal wiring area of the printed circuit board 1 and enhance the conduction effect. The intermediate portion 13 of the printed circuit board 1 defines a pair of spaced through holes 132 staggered disposed in the longitudinal direction of the printed circuit board 1, which plays a certain anti-dull effect. When the outer case 3 is over molded, the outer case 3 is passed through the through holes 132, to position the outer case 3. In this embodiment, the outer case 3 includes a front part (not labeled) enclosing the intermediate portion 13, and a rear part wider than the front part in the transverse direction, enclosing the connecting end 12. Notably, the area defined by the mating pads 110 is larger than the area defined by the connecting pads 120 in the front-to-back direction while is smaller in the transverse direction in compliance with the dimensions of the printed circuit board in the transverse direction Compared with the prior art, the intermediate portion 13 of the printed circuit board 1 of the plug connector assembly 100 according to the present invention is provided with recessing portions 130, so that the outer case 3 is filled in the recessing portion 130 when over molding, and then the outer case 3 covers the side edges of the intermediate portion 130 of the printed circuit board 1.

What is claimed is:

1. A plug connector assembly comprising:

a cable;

a printed circuit board including a mating end for inserting into a mating connector, a connecting end electrically connected with the cable, and an intermediate portion between the mating end and the connecting end, the mating end defining a plurality of conductive pads extending along a longitudinal direction of the printed circuit board for electrically connecting with the mating connector and arranged in a horizontal direction perpendicular to the longitudinal direction; and an outer case enclosing the intermediate portion of the printed circuit board and a part of the cable; wherein the intermediate portion defines on each of two side edges thereof a recessing portion filled by the outer case;

wherein the size along the horizontal direction of the intermediate portion is smaller than the size along the horizontal direction of the connecting end; wherein a conjunction portion of the intermediate portion and the connecting end of the printed circuit board is provided with a rounding structure to increase an internal wiring area of the printed circuit board; and wherein the conductive pads include a plurality of first mating pads, a plurality of second mating pads forwardly extending beyond the first mating pads, and a plurality of grounding pads disposed on a front side of the first mating pads, and the grounding pads are spaced and extending along the horizontal direction.

2. The plug connector assembly as claimed in claim 1, wherein a thickness of the side edge of each recessing portion to a corresponding side edge of the outer case is 0.55 mm.

3. The plug connector assembly as claimed in claim 1, wherein the intermediate portion of the printed circuit board defines a pair of spaced through holes.

4. The plug connector assembly as claimed in claim 3, wherein the pair of through holes are staggered along the longitudinal direction.

5. The plug connector assembly as claimed in claim 1, wherein the connecting end of the printed circuit board defines a plurality of soldering pads extending along the longitudinal direction and spaced along the horizontal direction, and the cable includes a plurality of core wires soldered to corresponding soldering pads.

6. The plug connector assembly as claimed in claim 1, wherein the printed circuit board includes a top surface and an opposite bottom surface, and the top and bottom surfaces are arranged exactly the same.

7. The plug connector assembly as claimed in claim 1, wherein the mating end of the printed circuit board is exposed to the outer case, and the size of the mating end along the horizontal direction is smaller than the size of a portion of the outer case enclosing the intermediate portion of the printed circuit board.

8. A plug connector assembly comprising:

a printed circuit board including a mating end, a connecting end and an intermediate portion between the mating end and the connecting end along a front-to-back direction, said printed circuit board further defining opposite first and second surfaces in a vertical direction perpendicular to said front-to-back direction;

a plurality of mating pads arranged in one row around the mating end on each of said first surface and said second surface along a transverse direction perpendicular to both said front-to-back direction and said vertical direction;

a plurality of soldering pads arranged in one row around the connecting end on each of said first surface and said second surface along said transverse direction;

a first dimension of the mating end in the transverse direction is smaller than a second dimension of the connecting end in the transverse direction while being larger than a third dimension of the intermediate portion in said transverse direction;

wherein said mating pads include a plurality of first mating pads for transmitting data signals, a plurality of second mating pads extending forwardly beyond the first mating pads and alternately arranged with the first mating pads in the transverse direction for transmitting grounding signals, and a plurality of grounding pads located in front of the corresponding first mating pads in the front-to-back direction and between the corresponding second mating pads in the transverse direction; and wherein said grounding pads are located behind front ends of the second mating pads in the front-to-back direction while extending in the transverse direction corresponding to at least two first mating pads.

9. The plug connector assembly as claimed in claim 8, further including an outer case enclosing both the intermediate portion and the connecting end except the mating end, wherein the outer case has a front part enclosing the intermediate portion and a rear part, which is wider than the front part in the transverse direction, enclosing the connecting end.

10. The plug connector assembly as claimed in claim 8, wherein the intermediate portion forms a pair of recessing portions in two opposite lateral sides, and each of said recessing portion is rectangular and extends in the front-to-back direction.

11. The plug connector assembly as claimed in claim 10, further including an outer case enclosing both the intermediate portion and the connecting end except the mating end, wherein the outer case has a front part enclosing the intermediate portion and a rear part, which is wider than the front part in the transverse direction, enclosing the connecting end.

12. The plug connector assembly as claimed in claim 11, wherein said recessing portion is filled with the outer case.

13. The plug connector assembly as claimed in claim 8, wherein a first area defined by the mating pads is larger than a second area defined by the connecting pads in the front-to-back direction while is smaller in the transverse direction.

* * * * *